US007644468B2

(12) United States Patent
Escarpa Gil

(10) Patent No.: US 7,644,468 B2
(45) Date of Patent: Jan. 12, 2010

(54) WRINGER FOR SCRUBBING BUCKETS

(75) Inventor: Julián Escarpa Gil, Aldaia (ES)

(73) Assignee: SP Berner Plastic Group, S.L., Valencia (ES)

( * ) Notice: Subject to any disclaimer, the term of this patent is extended or adjusted under 35 U.S.C. 154(b) by 0 days.

(21) Appl. No.: 11/510,525

(22) Filed: Aug. 25, 2006

(65) Prior Publication Data

US 2007/0094834 A1 May 3, 2007

Related U.S. Application Data

(63) Continuation of application No. PCT/ES2004/000374, filed on Aug. 13, 2004.

(30) Foreign Application Priority Data

Feb. 27, 2004 (ES) ..... 200400466

(51) Int. Cl.
*A47L 13/14* (2006.01)
*A47L 13/58* (2006.01)

(52) U.S. Cl. ..... 15/260; 15/261; 68/241

(58) Field of Classification Search ..... 15/260–263; D32/53; 68/241, 248; 100/131, 132
See application file for complete search history.

(56) References Cited

U.S. PATENT DOCUMENTS

| | | | | |
|---|---|---|---|---|
| 2,569,786 | A | 10/1951 | Stapt | |
| D499,223 | S * | 11/2004 | Libman et al. | D32/53 |
| 2002/0066152 | A1 * | 6/2002 | Dingert | 15/260 |

FOREIGN PATENT DOCUMENTS

| | | | |
|---|---|---|---|
| EP | 489237 | A1 * | 6/1992 |
| ES | 1022711 | U | 5/1993 |
| ES | 1032875 | U | 7/1996 |
| ES | 1041890 | U | 8/1999 |
| WO | WO 97/17008 | | 5/1997 |

* cited by examiner

*Primary Examiner*—Shay L Karls
(74) *Attorney, Agent, or Firm*—Klauber & Jackson L.L.C.

(57) ABSTRACT

The inventive wringer for scrubbing buckets basically consists of two independent tilting parts of a wringer (4) which are pivotally coupled inside the space of a support (1) fixed to the bucket mouthpiece. Said independent parts (4) are pivotally coupled with parallel axes communicating with the end spaces (3) of the support (1) and are tiltable oppositely to the resistance of spring elements (5).

9 Claims, 5 Drawing Sheets

WRINGER FOR SCRUBBING BUCKETS

RELATED APPLICATIONS

The present application is a Continuation of co-pending PCT Application No. PCT/ES2004/000374, filed on Aug. 13, 2004 which in turn, claims priority from Spanish Application Serial No. P200400466, filed on Feb. 27, 2004. Applicants claim the benefits of 35 U.S.C. §120 as to the PCT application and priority under 35 U.S.C. §119 as to said Spanish application, and the entire disclosures of both applications are incorporated herein by reference in their entireties.

OBJECT OF THE INVENTION

The present invention, as stated in the title to this descriptive specification, relates to a wringer for scrubbing buckets the purpose of which is to improve the wringing of the mop, as well as to facilitate the same without having to carry out any rotational movement on the mop when wringing it out.

Therefore, with the new wringer, when carrying out the wringing of the mop it will only be necessary to press down with the same, so that during this operation the structure of the wringer presses on the head of the mop.

BACKGROUND OF THE INVENTION

At the present time, mop wringers for scrubbing buckets exist which adapt to the mouthpiece of the buckets and have a structure which includes an inverted truncated-conical cavity with the bottom and side wall thereof having holes, so that to wring out the mop the head thereof is introduced inside pressing and rotating the mop to wring out the same.

Other wringers comprise a structure which includes a frame for securing to the mouthpiece of the bucket and a structure which incorporates downward convergent flexible elements which join in communication with a perforated lower base, so that when pressing down with the mop those elements press on the head in order to wring it out, so that when one ceases to push downwards with the mop, those elements recover their idle position.

Among these wringers are found the patents of invention numbers US2002/0066152 and EP 489237.

The first of these basically comprises an assembly of narrow flexible strands which define a truncated-conical space, at the same time as such strands converge downwards into a circular base.

On the other hand, the patent of invention number EP 489237 comprises two symmetrical assemblies of narrow flexible strands convergent toward the bottom which finish in an approximately rectangular base. U.S. Pat. No. 2,569,786 of Stapf describes a pivoted jaw mop wringer coupled on a mouthpiece of a bucket (17), comprising two independent tilting wringing pieces (7, 8), coupled inside the frame support (5, 6) that is secured to the mouth of the bucket and tilting against the resistance of a coil spring element (9). Said patent does not define a perimetral skirt and does not define short extensions emerging from a perimetral skirt for allowing its stacking avoiding fatigue of the spring elements. U.S. Pat. No. D499,223 of Libman describes a multipurpose bucket, having an element for anchoring the mop handle.

DESCRIPTION OF THE INVENTION

The wringer for scrubbing buckets which constitutes the object of the invention is wherein it comprises two perforated independent pieces with tilting movement against the resistance of flexible spring-like elements which maintain those confronting independent pieces in the idle position, which pieces are those which serve to wring out the mop when the same is pushed downward in the wringer.

Another characteristic of the invention relates to the two independent pieces which are coupled in communication with individual parallel axes mounted underneath in end spaces of a frame-support coupled on the mouthpiece of the scrubbing bucket.

Another characteristic is that the flexible spring-like elements consists of upward partitions which emerge at the bottom from the lower end parts of the frame-support in the proximity of the tilting axes of the two pieces, so that the end edges of such partitions have contact with and confront the arched edge of ribs which are part of the independent pieces, which structure is also new.

Thus, each of the independent pieces comprises a hollow structure open underneath comprising a domed upper base of arc-shaped form with a rear chamfer and a perimetral skirt, a part of which comprises a wide recessed surface having parallel slots constituting the perforations of the wringing action.

Joined to this recessed surface and at the rear part of the perimetral skirt are the ribs with arched edges and other reinforcement ribs parallel to the previous ones.

From the free edge of the sides of the perimetral skirt short extensions emerge which, when stacking prevent the weight of the various wringers and buckets from acting on the spring elements, achieving thereby that the latter lose efficacy when using the wringer. Thus the presence of those short extensions is intended to prevent the partitions from acting when the two wringer pieces descend due to the weight that they have to support through the stacking of several buckets, it being pointed out that the design of said buckets allows the introduction in their interior, resting on their lower base, of the assembly formed by the wringer pieces and their support. The weight of the stacked buckets would then damage the partitions losing their spring effect with the corresponding loss of wringing efficacy.

Furthermore, the pivotally coupled axes are mounted in communication with the free edge of the length of straight wall of the perimetral skirt. Such axes are configured as the result of small windows which limit portions of axis in the same direction as they are inserted in communication with complementary recesses established in other curved portions confronted with other small windows established in the two end spaces.

With the arrangement described, when the mop is inserted between the two wringer pieces an axial force is applied in the downward sense which transmits the downward movement to those two pieces against the resistance of the spring-like partitions.

The wringing operation consists basically in presenting the mop on the wringing surface which is in the idle state and, next, applying pressure in the downward sense, so that the two wringer pieces perform a rotational movement, in opposing directions, compressing the mop with the corresponding removal of the excess liquid.

With the new mop wringer, proper wringing is obtained, simply, by applying downward pressure on the wringing surface in contrast with the conventional wringers wherein correct wringing is achieved by means of pressure and turning the mop around an axial axis.

With the new wringing system, with respect to the conventional system, the effort to remove the excess liquid which the mop holds is substantially less and articular injuries are avoided or greatly reduced, like the well-known and very bothersome "tennis elbow".

Another characteristic of the invention are the tie members which constrain the downward tilting travel of the two independent pieces which perform the wringing. These tie members are joined at their ends to the bottoms of the end spaces of the frame-support.

They assist the upward partitions so that the wringing pieces do not end up breaking, on surpassing a certain degree of flexion. Contact is made on the tie members by short lengths of the edges of the perimetral skirt which is part of the wringing pieces.

The tie members have butts to brake the sliding over them by the lengths of the edge of each wringing piece, at the end of the tilting during the wringing action.

It also incorporates a new hook or anchor for the mop handle. It comprises a flexible arm which closes the space against the wall of the frame-support. It is more simple, effective and comfortable to use.

Another improvement relates to the structure which the pivotal coupling of the wringing pieces has, which coupling makes assembly simpler, being easier to automate, in that between the front wall and a boss with conical opening the axis or anchorage parts are taken to the corresponding place.

Next, to facilitate a better understanding of this descriptive specification and forming an integral part thereof, the same is accompanied with figures in which by way of illustration and not restrictively, the object of the invention has been represented.

DESCRIPTION OF THE PREFERRED MODE OF EMBODIMENT

Figure 1:
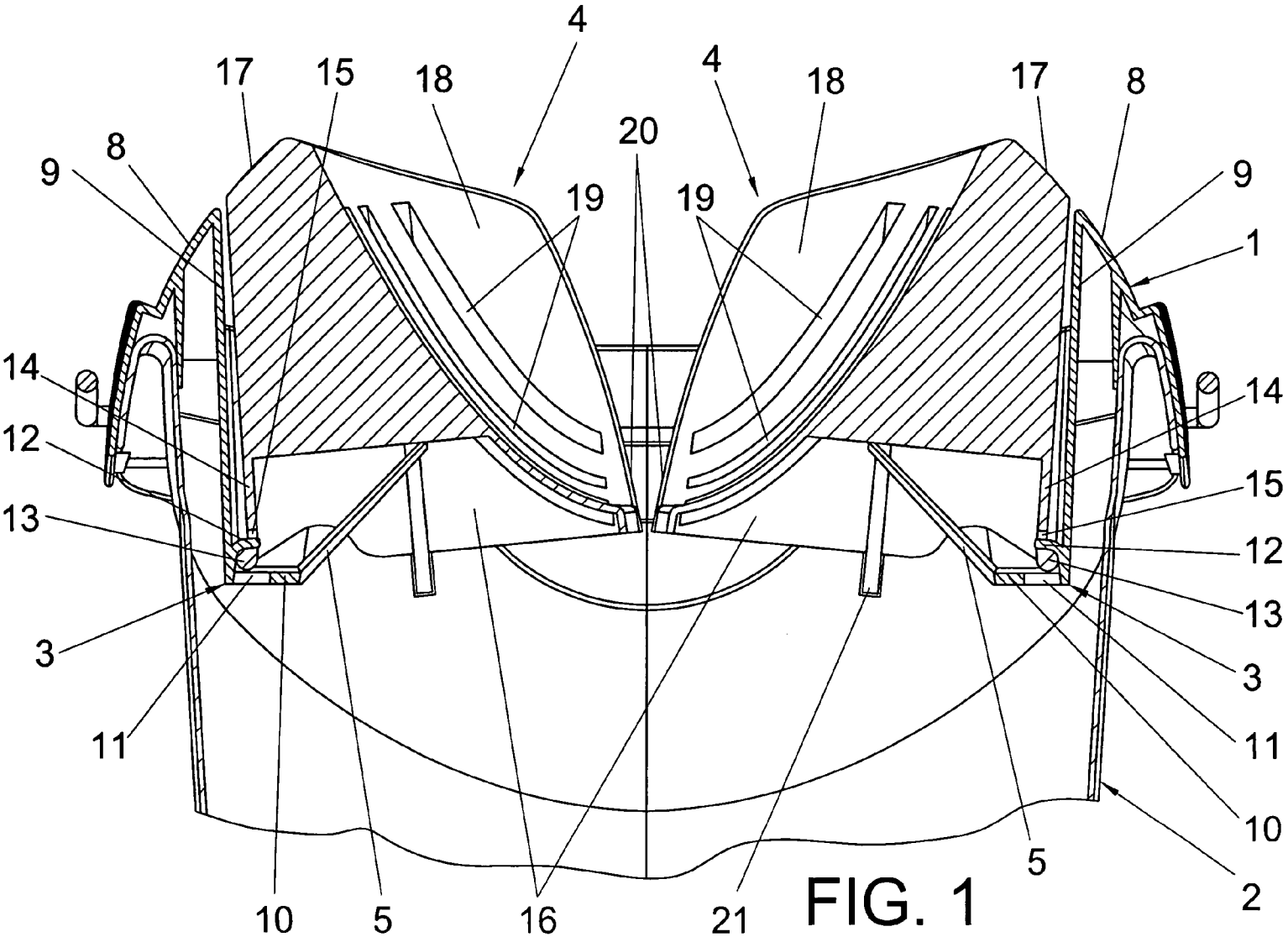
FIG. 1. It shows a view of the scrubbing bucket wringer, object of the invention. The wringer is in the idle position.
Figure 2:
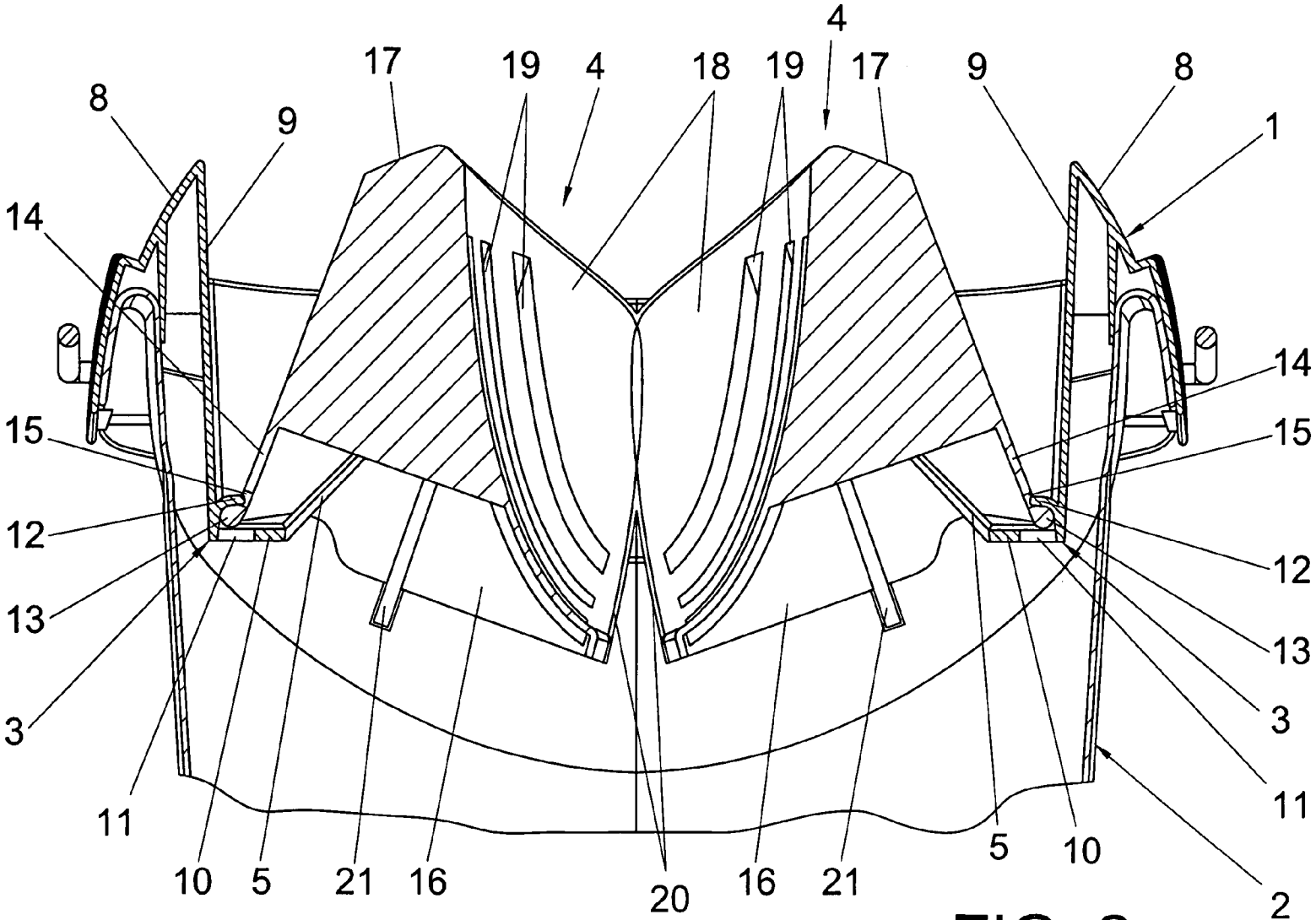
FIG. 2. It shows a view of the wringer in the active position.
Figure 3:
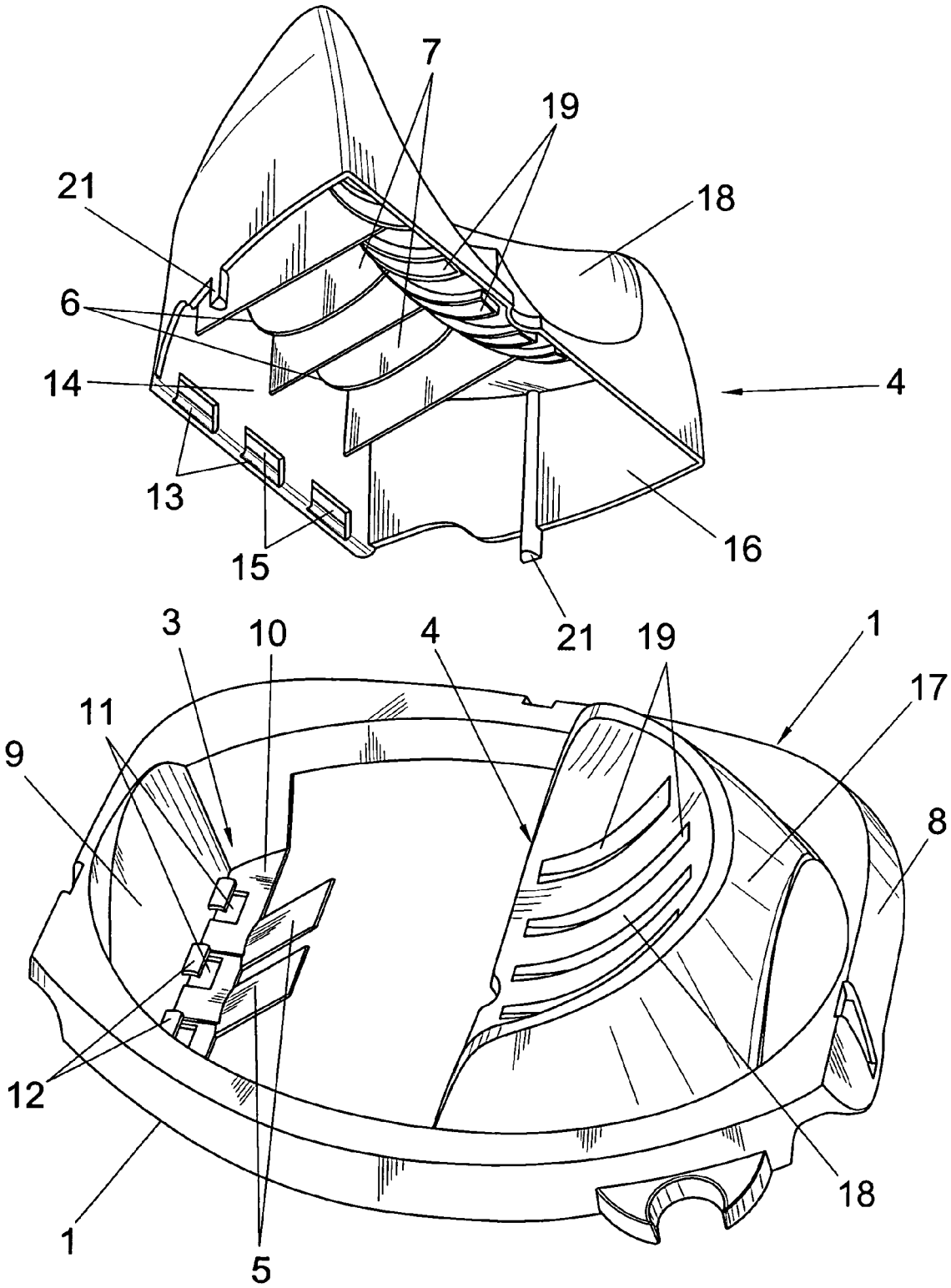
FIG. 3. It shows a perspective, exploded view of the wringer.
Figure 4:
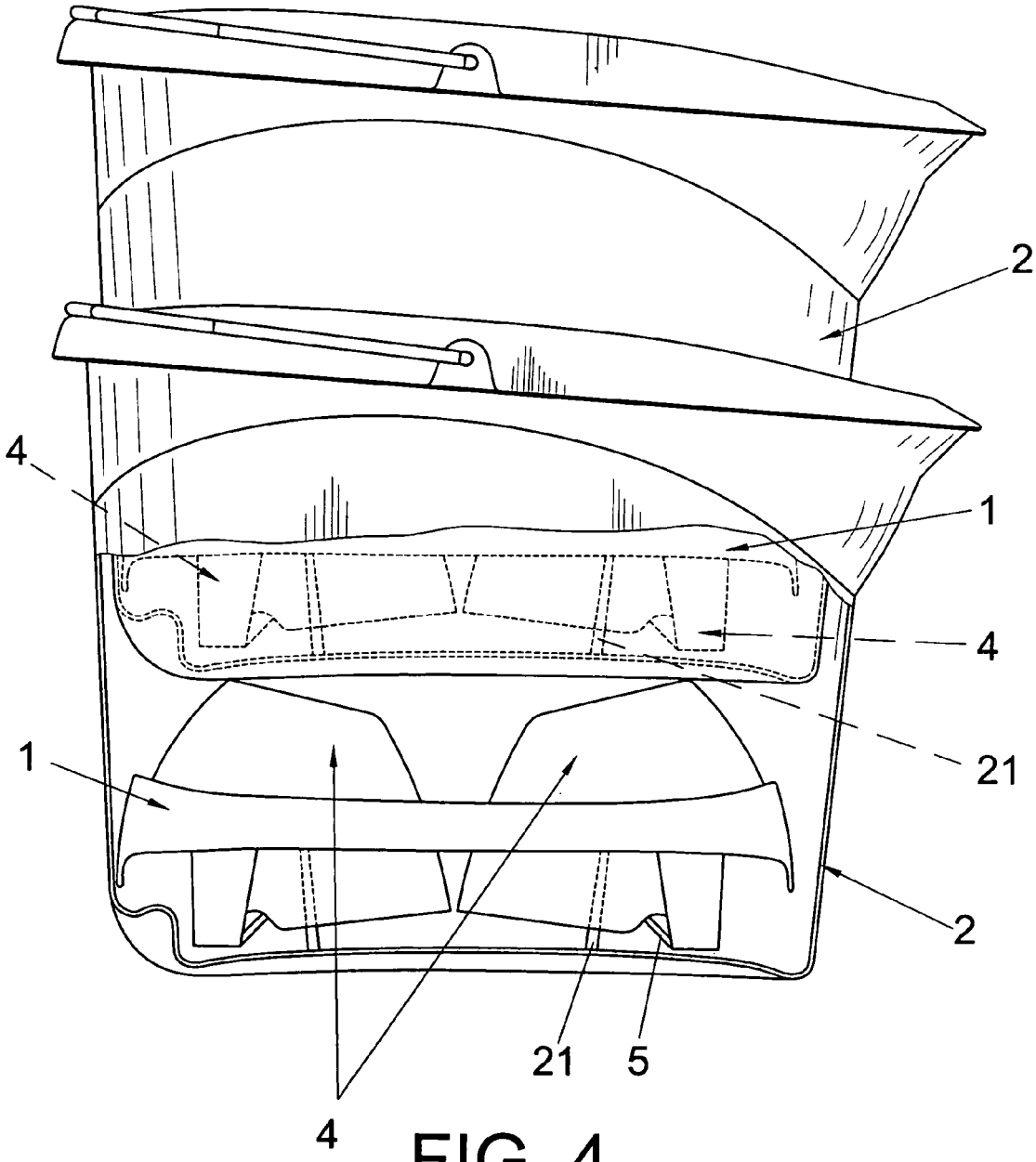
FIG. 4. It shows a view in schematic elevation of the stacking of several wringers together with the corresponding buckets.
Figure 5:
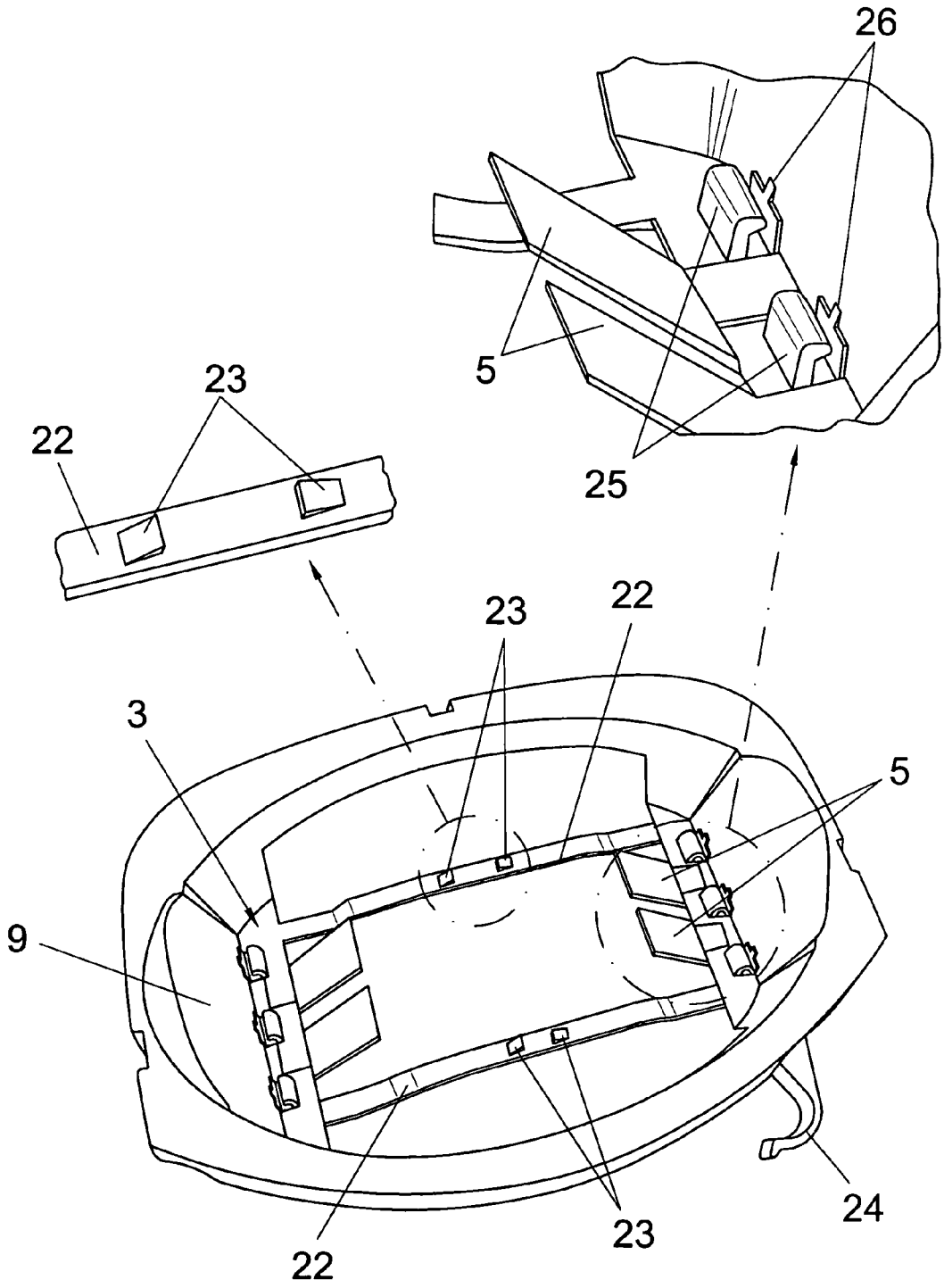
FIG. 5. It shows a view in perspective of a frame-support which is part of the wringer assembly of the invention.

Considering the numbering adopted in the figures, the wringer for scrubbing buckets is constituted from a frame-support 1 which is coupled on the mouthpiece of a bucket 2, whilst therein two end spaces 3 are defined where two independent and symmetrical pieces 4 are coupled pivotally against the resistance of upward partitions 5, the free ends of which are in contact with arched edges 6 of ribs 7 integral with the two independent pieces 4, which cover the interior space limited by the frame-support 1 which delimits a planar configuration in form of an ellipse, on the farthest ends of which small elevations 8 are defined corresponding with the end spaces 3 the latter limited by front walls 9 and lower planar bottoms 10 from which emerge the two upward partitions 5 by way of spring-like element.

In said planar bottoms 10 small windows 11 are defined confronting raised curved portions 12 where portions of axis 13 are coupled corresponding with the free edges of straight walls 14 which are part of the independent pieces 4, said portions of axis 13 originating as a consequence of other windows 15 established in such straight walls 14, which are arranged in communication with the front walls 9.

Each of the tilting pieces 4 consists of an enclosing structure defined by a perimetral skirt 16 which includes the straight wall 14, an arched and domed upper part 17 which limits a wide recessed front space 18 which has several parallel slots 19 for the wringing of the mop.

The confronting faces of the two symmetrical pieces 4 have arched end lengths 20 with the purpose that during the tilting the two pieces do not interfere through their nearest confronting faces.

The ribs 7 of arched edges 6 are arranged in the interior space of the pieces of enclosing structure 4, there being other reinforcing intermediate parallel ribs 7'.

Moreover, from the side ends of the perimetral skirt short extensions 21 emerge, which when stacking prevent the weight of the various wringers and buckets from acting on the spring elements 5, achieving with this that the same lose efficacy when using the wringer.

Tie members 22 have also been foreseen constraining the downward tilting wringing of the two independent wringing pieces 4. Said tie members 22 are joined at their ends by the bottoms 10 of the end spaces 3 of the frame-support 1.

The tie members 22 assist the upward partitions 5 so that the wringing pieces 4 do not lose efficacy nor end up breaking, on surpassing a certain degree of flexion. Contact is made by portions of the free edge of the perimetral skirt 16 on the tie members 22, which skirt is part of the wringing pieces 4.

The tie members 22 in turn incorporate small upper butts 23 to brake and to limit the sliding made thereon by the portions of the free edge of each wringing piece 4, precisely at the end of the tilting action during the wringing.

A new hook or anchor has also been foreseen for the mop handle. It comprises a flexible arm 24 which closes the space against the wall of the frame-support 1.

Lastly another articulated coupling system has been foreseen of the wringing pieces 4 in the end spaces 3.

For this, flukes have been foreseen in the form of an inverted "L" 25 which emerge from the bottom 10 of the end spaces 3, at the same time that such flukes 25 face small projecting portions 26 integral with the front wall 9 of the spaces 3, a conical opening being defined in this way between the free arms of the flukes 25 and the small projecting portions 26. With this new system the coupling and assembly will be simpler.

The invention claimed is:

1. WRINGER FOR SCRUBBING BUCKETS, which being coupled on a part of the mouthpiece of a bucket, consists of two independent wringing pieces which tilt against the resistance of spring elements, those two pieces being coupled inside a frame-support which is secured on the mouthpiece of the respective bucket wherein the independent wringing pieces consist of an enclosing structure including a perimetral skirt domed at its top, which limits a wide curved recessed and slotted surface, also incorporating inside the enclosing structure arched edge ribs and parallel ribs, the perimetral skirt consisting of a section of rear straight wall arranged in communication with front walls of the frame support, the two independent wringing pieces are pivotally coupled in individual parallel axes mounted in communication with end spaces of the frame-support, which spaces are defined by means of confronting front walls and lower bottoms, and the spring elements being defined by upward partitions integral with end spaces bottom, upward partitions free ends contact with arched edges of internal ribs that are integral with the tilting wringing pieces.

2. WRINGER FOR SCRUBBING BUCKETS, according to claim 1 wherein, the individual parallel tilting axes of the independent wringing pieces consist of alternate portions of axis corresponding with a free edge of straight walls of the perimetral skirt such portions of axis being coupled in complementary holes limited between the frame-support end spaces bottom and upper curved portions.

3. WRINGER FOR SCRUBBING BUCKETS, according to claim 1, wherein from a free edge of end sides of the perimetral skirt short extensions emerge, all of which in order to prevent the spring elements from being affected negatively during stacking.

4. WRINGER FOR SCRUBBING BUCKETS, according to claim 1, wherein it includes tie members joined by their ends to end spaces bottoms free edges; all of which in order to limit the downward tilting of the wringing pieces.

5. WRINGER FOR SCRUBBING BUCKETS, according to claim 4, wherein the tie members include pairs of upper protuberances whereon abut portion of the free edges of the perimetral skirt of the wringer pieces in their downward tilting limitation during the wringing action.

6. WRINGER FOR SCRUBBING BUCKETS, according to claim 1, wherein the frame-support incorporates an element for anchoring a mop handle, defined by a single flexible arm.

7. WRINGER FOR SCRUBBING BUCKETS, according to claim 1, wherein the individual parallel tilting axes of the wringing pieces consists of alternate portions of axis corresponding to a free edge of straight walls of said pieces, such alternate portions being coupled in holes of conical opening defined by flukes in the form of an inverted "L" and projecting portions integral with front walls of the frame-support, being said flukes, located at the end spaces bottom.

8. WRINGER FOR SCRUBBING BUCKETS, according to claim 1, wherein the individual parallel tilting axes of the wringing pieces consists of alternate portions of axis corresponding to a free edge of straight walls of said pieces, such alternate portions being coupled in holes of conical opening defined by flukes in the form of an inverted "L" and projecting portions integral with front walls of the frame-support, being said flukes located at the end spaces bottom.

9. WRINGER FOR SCRUBBING BUCKETS, according to claim 1, wherein the individual parallel tilting axes of the wringing pieces consists of alternate portions of axis corresponding to a free edge of straight walls of said pieces, such alternate portions being coupled in holes of conical opening defined by flukes in the form of an inverted "L" and projecting portions integral with front walls of the frame-support, being said flukes located at the end spaces bottom.

* * * * *